US006244589B1

(12) United States Patent
Gerlier

(10) Patent No.: US 6,244,589 B1
(45) Date of Patent: Jun. 12, 2001

(54) BANKNOTE STACKING APPARATUS

(75) Inventor: Andre Gerlier, Sciez (FR)

(73) Assignee: Mars Incorporated, McLean, VA (US)

( * ) Notice: Subject to any disclaimer, the term of this patent is extended or adjusted under 35 U.S.C. 154(b) by 0 days.

(21) Appl. No.: 09/338,481

(22) Filed: Jun. 22, 1999

(30) Foreign Application Priority Data

Jun. 23, 1998 (GB) ..... 9813559

(51) Int. Cl.[7] ..... B65H 29/44; B65H 31/14
(52) U.S. Cl. ..... 271/177; 271/219; 271/180
(58) Field of Search ..... 271/219, 180, 271/188, 299, 2, 177, 178; 209/919, 534, 900, 271

(56) References Cited

U.S. PATENT DOCUMENTS

| | | | | |
|---|---|---|---|---|
| 3,977,669 | | 8/1976 | Douno . | |
| 4,000,892 | | 1/1977 | Novak et al. . | |
| 4,050,562 | | 9/1977 | Schwippert et al. . | |
| 4,290,594 | * | 9/1981 | Ludemann et al. | 271/180 |
| 4,418,824 | | 12/1983 | Gorgone et al. . | |
| 4,556,139 | | 12/1985 | Akagawa et al. . | |
| 4,765,607 | | 8/1988 | Zouzoulas . | |
| 4,784,274 | | 11/1988 | Mori et al. . | |
| 4,807,736 | | 2/1989 | Kondo et al. . | |
| 4,809,966 | | 3/1989 | Kobayashi et al. . | |
| 4,809,967 | | 3/1989 | Kondo . | |
| 4,834,230 | | 5/1989 | Kondo et al. . | |
| 4,844,446 | | 7/1989 | Thie et al. . | |
| 4,856,768 | * | 8/1989 | Hiroki et al. | 271/186 |
| 5,013,026 | | 5/1991 | Howell . | |
| 5,014,857 | | 5/1991 | Kondo . | |
| 5,076,413 | * | 12/1991 | Davila et al. | 194/206 X |
| 5,314,177 | | 5/1994 | Anma . | |
| 5,322,275 | | 6/1994 | Gardellini et al. . | |
| 5,344,135 | | 9/1994 | Isobe et al. . | |
| 5,388,817 | | 2/1995 | Chang . | |
| 5,419,423 | | 5/1995 | Ishida et al. . | |
| 5,421,443 | | 6/1995 | Hatamachi et al. . | |
| 5,564,691 | | 10/1996 | Hatamachi et al. . | |
| 5,624,017 | | 4/1997 | Plesko . | |
| 5,639,081 | | 6/1997 | Hatamachi et al. . | |
| 5,662,202 | | 9/1997 | Suris . | |
| 5,676,366 | | 10/1997 | Polidoro . | |
| 5,803,227 | * | 9/1998 | Stein et al. | 194/206 |

FOREIGN PATENT DOCUMENTS

| | | |
|---|---|---|
| 28 47 774 A1 | 5/1980 | (DE) . |
| 0 470 329 B1 | 12/1992 | (EP) . |
| 0 747 866 A1 | 11/1996 | (EP) . |
| 0 751 487 A1 | 2/1997 | (EP) . |
| 53-032097 | 3/1978 | (JP) . |
| 57-081049 | 5/1982 | (JP) . |
| 61-055037 | 3/1986 | (JP) . |
| WO 94/19269 | 1/1994 | (WO) . |

* cited by examiner

*Primary Examiner*—Christopher P. Ellis
*Assistant Examiner*—Kenneth W Bower
(74) *Attorney, Agent, or Firm*—Fish & Richardson P.C.

(57) ABSTRACT

A device for stacking banknotes, comprising a cashbox and a stacker arranged to stack banknotes of predetermined dimensions in said cashbox, said cashbox having a surface including an aperture therein, said aperture having a dimension in a first direction of W, said device being arranged to receive a banknote at a position overlying said aperture, said banknote having a dimension in said first direction of L, said stacking means being arranged to push said banknote through said aperture and into a stacked position in said cashbox, wherein said banknote is pushed to a predetermined maximum depth D in said cashbox relative to said aperture such that D<(L−W)/2.

27 Claims, 12 Drawing Sheets

BANKNOTE STACKING APPARATUS

TECHNICAL FIELD

This invention relates to an apparatus for forming a stack of sheet-like objects, in particular but not exclusively a stack of banknotes formed in a cashbox.

BACKGROUND ART

Various devices are known for forming stacks of banknotes. One such device is described in published European patent application No. 0684929. This discloses an apparatus which incorporates a pusher plate with which a banknote may be pushed from the plane along which the banknote is transported to the stacking mechanism (transport plane), into a cashbox situated adjacent to the banknote plane. The pusher plate is connected by a pivoted lever arrangement via a cam, to a drive motor. The pivoted lever arrangement operates with a "scissors action" to cause the pusher plate to push the banknote into the cashbox against the action of a spring mounted stack surface. The banknotes are retained in a stack in the cashbox, when the pusher plate is withdrawn, by flanges which abut the ends of the uppermost surface of the banknote stack.

Although this type of arrangement provides an efficient method of stacking banknotes, the required depth of stroke of the pusher plate is linked to the size of the aperture through which the banknote is pushed. Thus, a short depth of stroke is only possible if the aperture is relatively large. However, cashboxes with relatively large apertures suffer from the disadvantage of being difficult to make secure (i.e. self closing) on detachment from the stacking device. The cashbox aperture may be made smaller by increasing the depth of stroke of the pusher plate. However, an increased depth of stroke results in an increased cashbox depth for any given size of banknote stack. As space is often at a premium in such circumstances, for example in combined banknote validator and stacker devices, this too is an undesirable consequence.

Furthermore, if banknotes of differing lengths are to be stacked in a cashbox incorporating stack retaining flanges, the aperture must be significantly shorter than the length of the shortest banknote to be stacked. This is in order that the flanges at the ends of the aperture may retain even the shortest banknotes. This results in a minimum length of pusher plate stroke being further increased in order to successfully stack the longest banknotes through the same aperture size and hence a corresponding increase in the depth of the cashbox.

In order that the flanges should retain the stack of banknotes, it may be important that the banknotes are presented for stacking in a predetermined orientation. For example, if a banknote of maximum length is skewed on being stacked, its greater diagonal length may prevent it from being successfully stacked. Additionally, it may also be important that the banknotes are accurately positioned lengthwise with respect to the cashbox aperture, in order to be reliably stacked. A sufficient lengthwise offset will result either in an end of the banknote not being stacked, or alternatively an end of the banknote not being retained by a flange, or both.

As cashboxes used with such devices often incorporate a spring mounted stacking surface against which a pusher plate or piston must work, a further problem may arise in such devices. Namely, despite successfully pushing the banknote into the cashbox, the banknote may not completely flatten against the stack. As the stack surface is again biased against the retaining flanges by the spring mounted stacking surface banknotes may become crumpled, causing an irregular banknote stack.

U.S. Pat. No. 4,809,967 and U.S. Pat. No. 5,014,857 disclose a stacking device of the piston type which aims to address the problem of ensuring that banknotes flatten correctly on the stack surface during the stacking process. These disclosures teach to incorporate pivotally mounted "unfolding" plates in the piston assembly. These are arranged to displace horizontally as the piston stroke increases in the vertical direction; thus assisting in flattening a banknote against the stack.

However despite assisting with flattening banknotes in the stacking procedure the device of U.S. Pat. No. 4,809,967 and U.S. Pat. No. 5,014,857 suffers from the same drawback as that of EP 0684929A, in that a short depth if stroke is only possible of the cashbox aperture is relatively large; or, conversely a small aperture is only achievable if the stroke length is relatively long.

A further stacking device is disclosed in U.S. Pat. No. 4,834,230 and U.S. Pat. No. 4,807,736 which employs a pair of rotors in place of a piston in order to stack banknotes in a cashbox. However, like the device of U.S. Pat. No. 4,809,967 and U.S. Pat. No. 5,014,857, this device suffers from the disadvantage that a short depth of stroke is only possible if the cashbox aperture is relatively large. Additionally, such a device may suffer from the disadvantage of a banknote being incorrectly stacked (for example, one end of the banknote not being retained in the cashbox by a retaining flange) if the banknote is erroneously presented for stacking in a non-central manner.

A further such device is described in granted European patent 0470329. This discloses an apparatus which transports banknotes between opposing belts entrained around rollers of a carriage, which is arranged to traverse an open surface of a cashbox. As the carriage moves over the stack of banknotes, the entrained banknote is deposited on the stack. The stack of banknotes is retained in the cashbox by one of the transporting belts which lie across the uppermost surface of the banknote stack.

Such a device does not require vertical movement of the piston or pusher, and hence the cashbox depth can be smaller for a given capacity. However, this arrangement also requires the cashbox construction to be substantially open and consequently difficult to make secure on detachment from the stacking device. Indeed in such a design the aperture of the cashbox must be at least as large as the banknotes which are to pass through it.

SUMMARY OF THE INVENTION

In accordance with the present invention there is provided a device for stacking banknotes, comprising a cashbox and a stacker arranged to stack banknotes of predetermined dimensions in said cashbox, said cashbox having a surface including an aperture therein, said aperture having a dimension in a first direction of W, said device being arranged to receive a banknote at a position overlying said aperture, said banknote having a dimension in said first direction of L, said stacking means being arranged to push said banknote through said aperture and into a stacked position in said cashbox, wherein said banknote is pushed to a predetermined maximum depth D in said cashbox relative to said aperture such that $D<(L-W)/2$.

It will be appreciated that where a standard reciprocating piston action is used to push a banknote through an aperture of a cashbox which is narrower than the width of the banknote, a relationship between the minimum required depth of stroke to push a given banknote completely through the aperture and the width of the aperture may be derived.

This minimum stroke depth occurs when the banknote is pushed through the aperture symmetrically across its width. In this case the banknote will be pushed entirely within the cashbox when the piston stroke, relative to the aperture, is equal to half the difference between the banknote width and the aperture width.

However in mechanisms according to the present invention the relationship between the aperture width and the stroke depth is not fixed in this manner for a given banknote size. Thus a reduced cashbox aperture size may be achieved without necessitating a long stroke length. Therefore improved cashbox security and a reduced cashbox size may advantageously be achieved.

In a further aspect of the invention there is provided a device for stacking documents comprising a stacker and a stack surface, the stacker being arranged to push a document partially through an aperture defined by at least one surface such that the document at least partially contacts the stack, the stacker being further arranged to move along the stack and under the surface, entraining the document through said aperture into a stacked position, wherein the stacker comprises an extensible membrane positioned between the stacker and the document, arranged to contact the document during the stacking procedure.

By incorporating a flexible membrane in the stacking device, between the stacker and the document (for example a banknote), the degree of control over the document may be increased. Thus the possibility of the document being incorrectly stacked, due to slippage between the stacker and the document or the document being damaged in the stacking process, is significantly reduced.

Other aspects and embodiments of the invention, with corresponding objects and advantages, will be apparent from the following description and claims. The invention will now be illustrated, by way of example only, with reference to the accompanying drawings, in which:

DESCRIPTION OF THE PREFERRED EMBODIMENTS

First Embodiment

Figure 1:
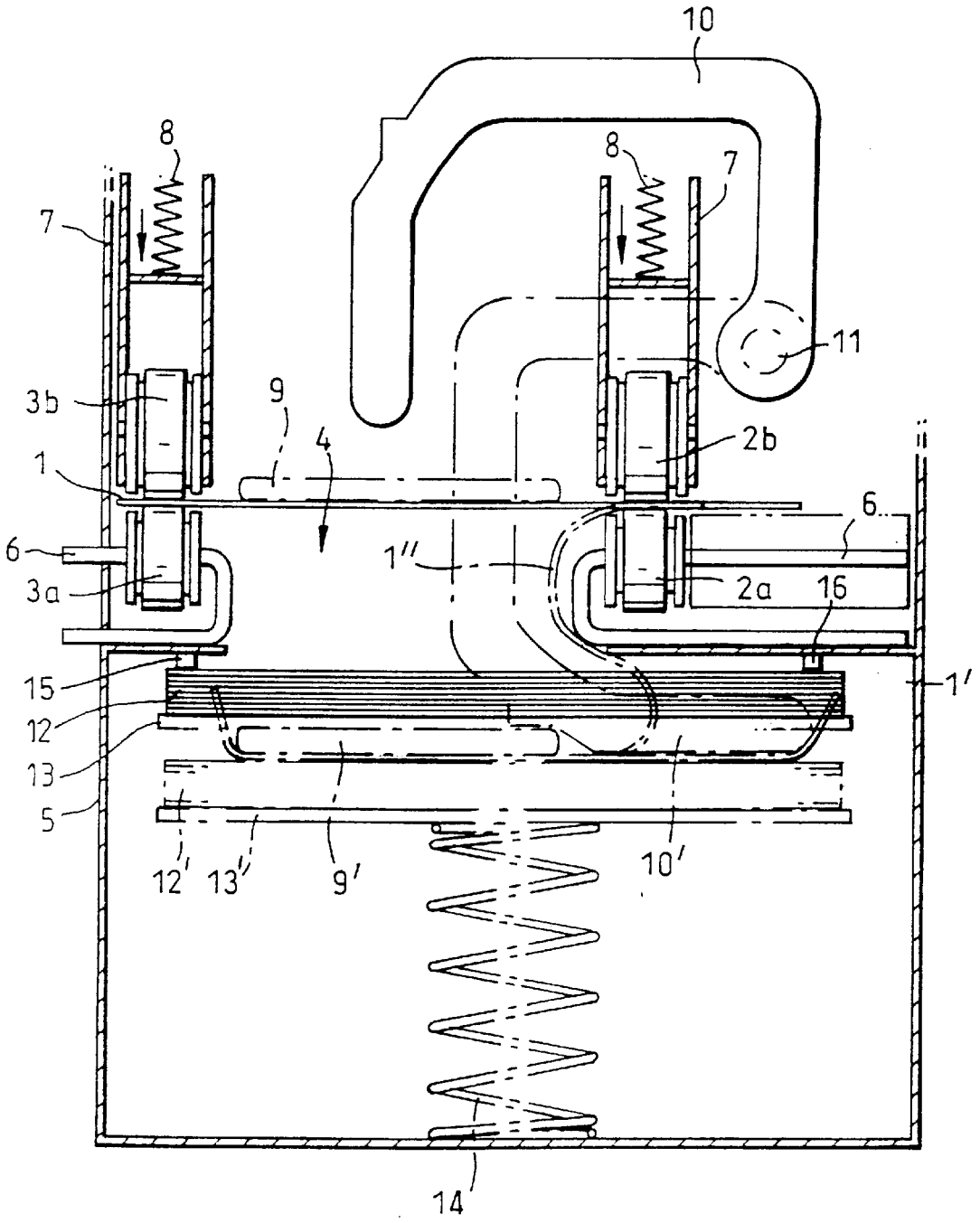
FIG. 1 is a 0.62:1 scale diagram illustrating the structure and function of the banknote stacking mechanism according to a first embodiment of the invention.

Referring to FIG. 1, a banknote stacking system according to the first embodiment of the invention is shown. The system comprises a banknote transport system, a stacking mechanism and a cashbox 5. The stacking mechanism and the transportation mechanism are housed in a banknote handling apparatus, such as a validator (shown in FIG. 10), to which a cashbox 5 is removably attached.

Banknote Transport System

A banknote 1 is transported to the stacking mechanism in a direction perpendicular to the plane of the diagram by the transportation mechanism, which comprises opposing pairs of rollers 2*a*, 2*b* and 3*a*, 3*b*. The banknote 1 is engaged by transportation rollers 2*a*, 2*b*, 3*a*, 3*b* parallel to its lengthwise edges. That is to say it is transported in the direction of its longitudinal axis. The spacing between the pairs of rollers 2*a*, 2*b* and 3*a*, 3*b* is arranged such that even the minimum size of banknote for which the mechanism is designed may be securely held and transported.

The rollers 2*a*, 2*b*, 3*a*, 3*b* position the banknote 1 above an aperture 4 of the cashbox 5. In this embodiment, the aperture 4 is approximately half of the width of the banknote; i.e. approximately 31 mm across. The position of the leading edge of the banknote 1 is sensed using photosensors (not shown), or other suitable position sensing devices, which are occluded by the banknote 1 when it is in the correct position. The output from the photosensors is then used to inhibit further transport of the banknote 1.

The rollers 2*a*, 2*b*, 3*a*, 3*b* are located on either side of the aperture 4, such that the banknote 1 is gripped with a positive force and held flat and parallel to the aperture 4 prior to being stacked. This is achieved by mounting the lower rollers 2*a*, 3*a* on fixed axles 6 and mounting the opposing rollers 2*b*, 3*b* on shafts 7, which are free to move to a limited extent in the vertical direction. The shafts 7 are biased downwards towards the lower rollers 2*a*, 3*a* by compression springs 8 contained within the shafts 7.

Although rollers are used in the present embodiment for the transportation of the banknotes, a belt driven transportation system could alternatively be used.

Stacking Mechanism

The stacking mechanism comprises a pusher plate 9, a rotor 10 and a stack support surface 13 located inside the cashbox 5.

Pusher Plate

The pusher plate 9 comprises a flat plate made from a plastics material or metal. It is connected by the centre of its upper surface to a solenoid (not shown) using any suitable fastening. The solenoid is arranged to cause the pusher plate 9 to reciprocate in a vertical direction. The solenoid may however be replaced by other suitable means. For example, a pivoted lever arrangement driven by an electric motor via a cam, as discussed with reference to published European patent application No. 0684929.

Rotor

Figure 2A:
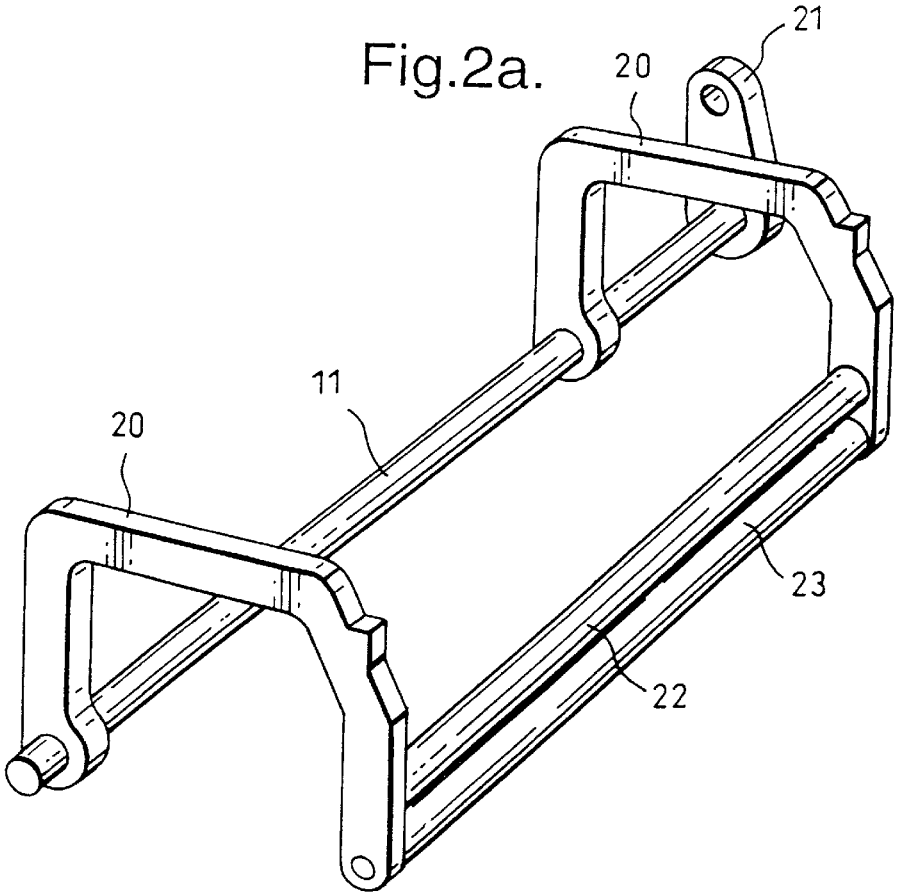
FIG. 2*a* is a perspective view of a rotor which may be used in first, second and fourth embodiments of the invention.
Figure 2B:
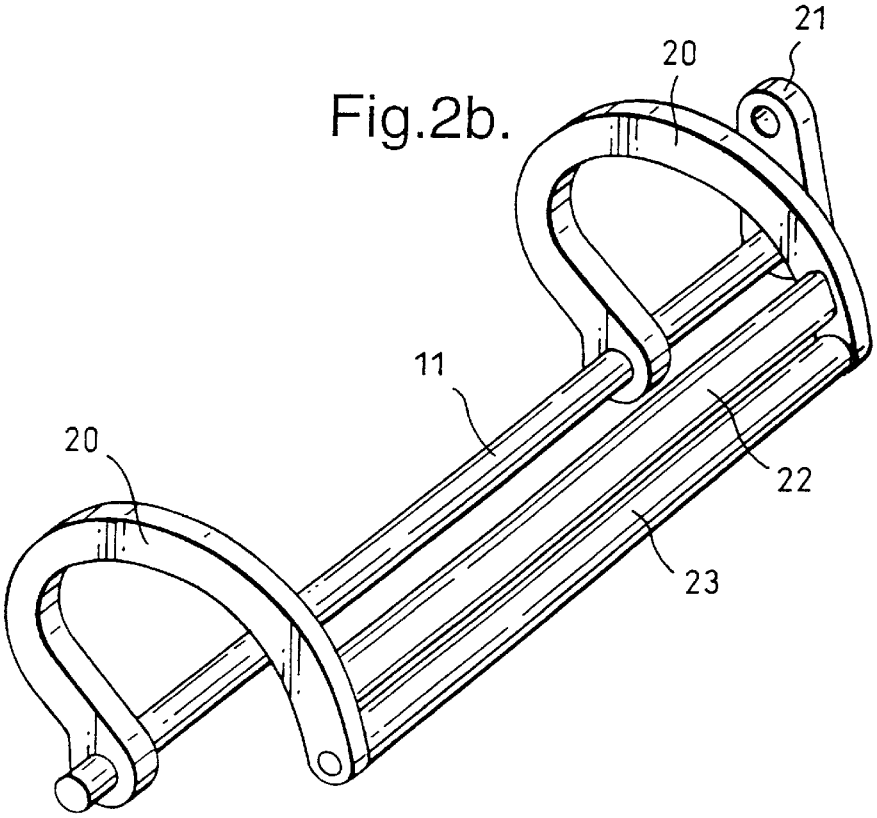
FIG. 2*b* is a perspective view of an alternative rotor design which may be used in first, second and fourth embodiments of the invention.

A detailed view of the rotor 10 is shown in FIG. 2*a*. The rotor 10 comprises two rotor arms 20 mounted on an axle 11. In this embodiment the rotor arms 20 have a straight sided profile. However, various other profiles may be used, for example a circular profile extending through 93°. as shown in FIG. 2*b*. At one end of the axle 11 is situated a crank arm 21 through which rotational movement is applied to the rotor 10 by an electric motor and gear train (not shown). A support bar 22 connects the two rotor arms 20 and provides added rigidity to the rotor assembly. Adjacent the support bar 22, situated between the extremities of the rotor arms 20, is a rotating axle 23, which forms a banknote engaging surface. Since it is free to rotate relative to the banknote 1 during the stacking process the levels of friction acting on the banknote 1 are reduced. This may be beneficial as the banknote 1 may otherwise be prone to tearing during the stacking process, especially if the mechanism is operating at high speed. The rotating axle 23 may alternatively be replaced by a non-rotating banknote contacting surface made from a low friction material such as PTFE.

The separation between the two rotor arms 20 in the direction of the axle 11, is chosen such that the overall width of rotor 10 is slightly less than the corresponding dimension of the aperture 4, through which it must pass. This ensures that a high degree of control over the banknote 1 is achievable during the stacking process.

The entire rotor assembly may be manufactured by any suitable means such as a one piece plastics injection moulding, with the exception of rotating axle 23 which may be joined to the main rotor assembly by means of a snap fit. Alternatively, it may be manufactured through individually machined or moulded plastics or metal components, or a combination thereof.

Stacking Process

Prior to the actuation of the stacking mechanism, the positive gripping force exerted by the roller 3*b* is removed from the banknote 1. This achieved by raising the associated shaft 7 using a solenoid (not shown), against the spring force of the spring 8 to give a clearance between the rollers 3*a* and 3*b*. Alternatively, this may equally be achieved by lowering the roller 3*a* relative to roller 3*b*.

The benefit of giving a clearance between the opposing rollers 3*a* and 3*b* is to ensure that banknote 1 will not be subject to undue stress which might cause it to tear on being stacked. It should be noted that at this stage the rollers 2*a*, 2*b* continue to engage the right-hand end of the banknote 1 as shown in FIG. 1.

The pusher plate 9 is initially situated in its resting position parallel to and slightly above the transport plane of the banknote 1, as shown in FIG. 1. On actuation, the pusher plate 9 descends through the transportation plane of the banknote 1, through the aperture 4 of the cashbox 5 to the required depth. The required depth must be sufficient for the left-hand end of the banknote 1 to be entrained through the aperture 4 and fall beneath the left-hand abutment surface 15 as shown in FIG. 1. The pusher plate 9 descends no further than the minimum distance required in order to ensure reliable stacking of the banknote 1, in order to allow the depth of the cashbox 5 to be minimised for a given capacity.

This action causes the free left-hand end of the banknote 1 to be pushed through the aperture 4 of the cashbox 5 and on to a stack surface, which may be either a support plate 13, or the surface of a stack of banknotes 12 already stacked on support plate 13.

Since the right-hand end of the banknote 1 is held between the rollers 2*a*, 2*b*, the surface of the banknote 1 will move laterally in relation to the pusher plate 9 as it descends into the cashbox 5. This situation is illustrated by the dashed representations of the pusher plate and the banknote referenced 9' and 1' respectively.

The support plate 13 is supported upon a compression spring 14. The compression spring 14 compresses to take up any excess travel in the length of stroke of the pusher plate 9, beyond that required to bring the left hand end of banknote 9 into contact with stack surface 12; 13, as shown in FIG. 1. The position of the support plate 13 and the compression spring 14 when the pusher plate is fully lowered are shown by dashed representations of the support plate 13' and the compression spring 14'. The degree to which the compression spring 14 is compressed depends upon the height of any existing banknote stack on the support plate 13.

At this stage, the right-hand roller pair 2*a*, 2*b* is disengaged, thus freeing the right-hand end of the banknote 1, as shown in FIG. 1. However, as the left-hand end of the banknote 1 is securely maintained on the stack surface 12; 13 by the pusher plate 9, the position of the banknote 1 is positively controlled throughout.

The rotor mechanism 10 is then actuated, driven by a reversible DC motor and drive train (not shown). The rotor 10 is rotated approximately 90° anti-clockwise, with reference to FIG. 1, from its resting position (shown in solid line) where the rotating axle 23 of the rotor 10 is positioned above the resting position of the pusher plate 9, to its extended position (shown in dotted line referenced by numeral 10'). This causes the right-hand end of banknote 1 to be withdrawn from the clearance between rollers 2*a* and 2*b*, entrained downwards through the aperture 4 and unrolled sideways along the stack surface 12; 13, such that it falls beneath the right-hand hand abutment surface 16, as shown in FIG. 1.

It will be noted from FIG. 1 that the maximum depth of penetration of the rotor 10 into the cashbox 5 is no more than that of the pusher plate 9. This ensures that the movement of the rotor 10 is not obstructed by the stack surface 12; 13.

It will also be noted that the maximum dimensions of the pusher plate 9 are limited by the corresponding dimensions of the aperture 4. Within this constraint it is desirable that the banknote contacting area of the pusher plate 9 is large to increase the control over the positioning of the banknote 1. Unlike known stacking systems, the size of the pusher plate 9 of the present embodiment is not directly related to the depth of stroke of pusher plate.

When the banknote 1 is fully contacting stack surface 12; 13, the rotor 10 rotates clockwise, as shown in FIG. 1, back to its resting position and subsequently the pusher plate 9 is also returned to its resting position above the banknote transport plane. As the pusher plate 9 is returned to this position, the compression spring 14 returns the stack surface 12; 13 to its uppermost limit, against the movement of the pusher plate 9. This movement of the stack surface is limited by the abutment surfaces 15, 16 located on the interior surface of the cashbox 5.

Thus, stack surface 12; 13 is continually under a compressive load between compression spring 14 and pusher plate 9 or abutment surfaces 15, 16. Because the banknote is flattened on the stack surface by the stacking mechanism, the scope for a banknote to become incorrectly positioned prior to being forced against the abutment surfaces 15,16 is greatly reduced.

Subsequently, rollers 2*a*, 2*b*, 3*a*, 3*b* are re-engaged in order to receive a further banknote 1 to be stacked, at which time the stacking cycle is ready to restart.

In this embodiment, despite the fact that the pusher plate 9 and the initial position of banknote 1 are centrally located with respect to the rollers 2*a*, 2*b*, 3*a*, 3*b*, the final stacked position of the banknote 1 is offset with respect to this position. This offset is a function of the distance between the banknote transport plane and the length of stroke of pusher plate 9.

It will be apparent to the skilled reader that the present embodiment of the invention is tolerant of misalignment of the banknote 1 as it is presented for stacking at the stacking mechanism, since no datum edge is relied upon in order to effect the stacking operation. Furthermore, because each banknote 1 is effectively stacked by positioning part of the banknote 1 on the stack 12 and subsequently flattening the remainder against the stack 12, this embodiment is also able to cope with a wide range of banknote sizes.

Second Embodiment

Referring to FIG. 3, a stacking mechanism according to the second embodiment of the invention is shown. Features in the second embodiment which are similar to features already discussed with reference to the first embodiment, are referenced using the same numerals and are not discussed further in detail. Unlike the first embodiment, the second embodiment does not utilise a pusher plate or piston in the stacking process but incorporates two rotors with the circular profile shown in FIG. 2*b* and as described with reference to the first embodiment.

Banknote Transport System

In this embodiment, the banknote 1 is transported to the stacking mechanism by a banknote transport system similar to that described with reference to the first embodiment.

However, in this embodiment the banknote 1 is transported in the region of the stacking mechanism by drive rollers 30 situated above the banknote transport plane and at either side of the cashbox aperture 4. Each drive roller 30 is opposed by a trapped bearing 32 situated beneath the banknote transportation plane.

The drive rollers 30 are supported rigidly on axles 31 and the trapped bearings 32 are mounted along opposing edges 26 of the cashbox aperture 4, such that they have two rotational degrees of freedom.

The trapped bearings 32 may be manufactured from metal or plastics material and are mounted proud of the profile of the upper surface of the cashbox 5. The drive rollers 30 are manufactured from plastics or any other suitable material and have a rubberised tyre or circumferential surface to positively grip the banknote 1.

The spacing between the drive rollers 30 and the trapped bearings 32 on either side of the aperture 4 is such that even the minimum width of banknote for which the mechanism is designed may be securely held and transported.

In this embodiment (illustrated in FIGS. 3*a*–*d* in 1:1 scale) the maximum banknote width is approximately 95 mm. The minimum banknote width is approximately 70 mm. In this instance this is limited by the spacing of abutment surfaces 15 and 16. In practice this spacing could be reduced to a slightly greater width than the aperture width if required. In this embodiment the aperture width is approximately 24 mm.

As in the first embodiment, transportation belts may be used in the place of rollers.

Stacking Mechanism

Figure 3A:
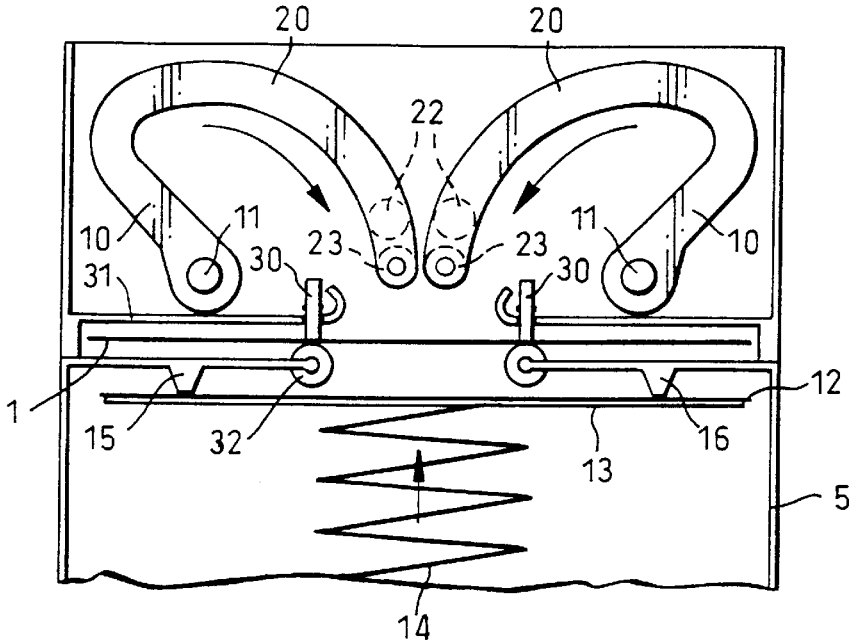
FIGS. 3*a–d* are a series of diagrams shown in 1:1 scale illustrating the structure and function of the banknote stacking mechanism according to a second embodiment of the invention.

The stacking mechanism in this embodiment comprises two rotors 10, each as described with reference to the first embodiment. Each rotor 10 is mounted and driven in a similar manner to that described with reference to the first embodiment. Referring to FIG. 3*a*, the rotors 10 are shown to be mounted opposing each other, with sufficient clearance between them in order that they do not interfere with each other when they are rotated about their axes 11.

Stacking Process

Referring to FIG. 3*a*, a banknote 1 is shown having been transported between the drive rollers 30 and the trapped bearings 32 to a position above the cashbox aperture 4. The banknote 1 is shown as being transported to the stacking mechanism in a direction perpendicular to the plane of the diagram by the transportation mechanism.

As with the first embodiment, prior to the actuation of the stacking mechanism, the positive gripping force exerted by the rollers 30 is removed from the banknote 1. This is achieved by raising the associated mounting axles 31 to give a clearance between the rollers 30 and the trapped bearings 32. However, unlike the first embodiment in which the rollers on one side of the banknote only are released, this occurs on both sides of the banknote 1 in the present embodiment.

FIG. 3*a* illustrates the start of the stacking process. The rotors 10 are caused to rotate in synchronism about their respective axles 11 in the directions indicated by the arrows in the Figure. As was described with reference to the first embodiment, the movement of the rotors 10 is entrained using an electric motor and a gear train (not shown). As the angle of rotation of each of the rotors 10 increases, the rotating axles 23 of the rotors 10 are brought into contact with the upper surface of the banknote 1, in a roughly central position with respect to the banknote 1. The synchronous operation of the rotors 10 ensures that the force exerted on banknote 1 is even. The possibility of the banknote 1 being skewed upon being stacked is therefore diminished.

Figure 3B:
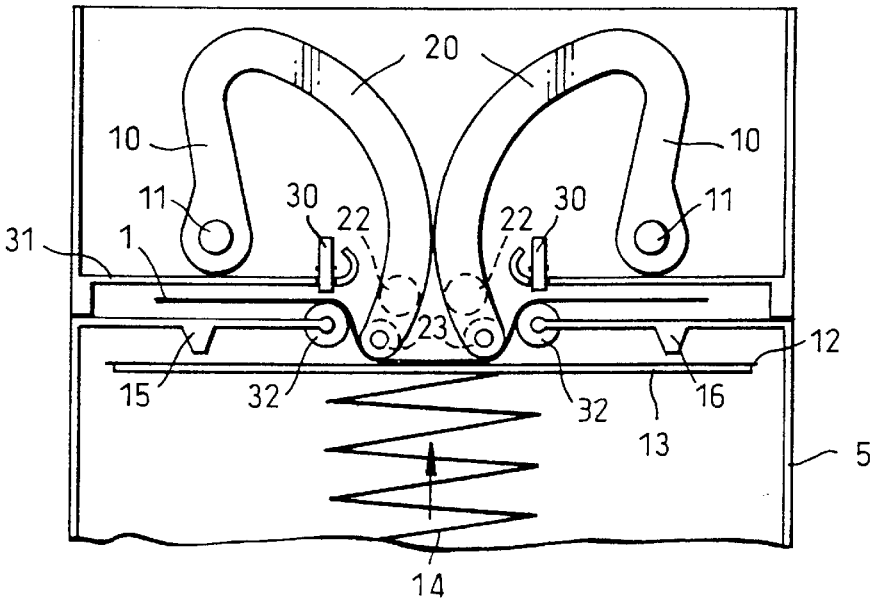

Continued rotation of rotors 10 causes the banknote 1 to be entrained around the rotating axle 23 of each rotor 10 and onto stack surface 12; 13, as is shown in FIG. 3*b*.

As the trapped bearings 32 are free to rotate both in the direction of transportation of the banknote 1 and in the perpendicular direction, the banknote 1 is freely moveable both in the transportation stage, and subsequently downwards in the direction of the cashbox 5 during the stacking process.

Alternatively, this objective may be achieved by arranging the trapped bearings 32 to be moveable with respect to the fixed drive rollers 30. Prior to the stacking process they may be lowered in order to allow the banknote 1 to be stacked freely.

As the rotors 10 continue to rotate, their rotating axles 23, diverge from one another along the upper surface of the banknote 1. As previously described, the rotation of the rotating axles 23 ensures that no undue frictional forces are exerted on banknote 1, thus reducing the chance of banknote 1 being damaged during the stacking process.

Figure 3C:
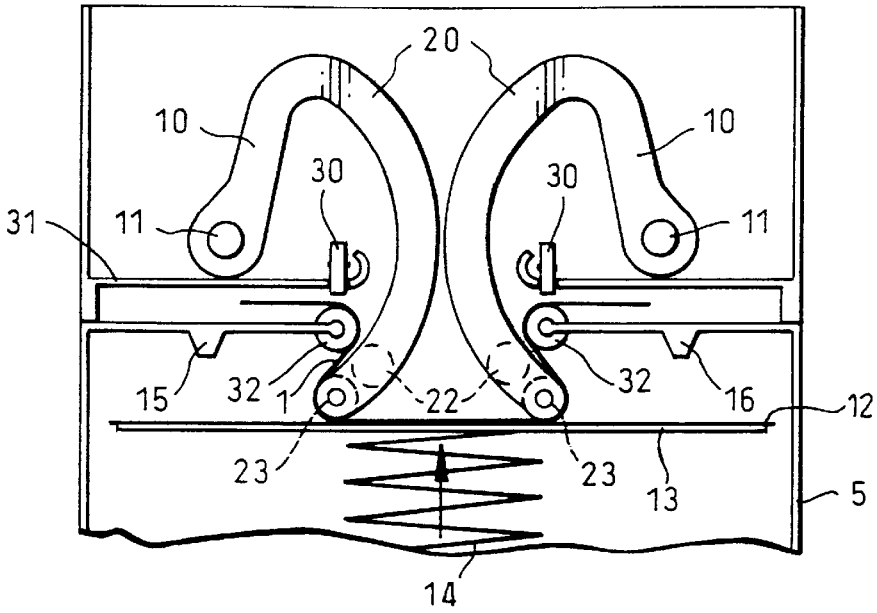
Figure 3D:
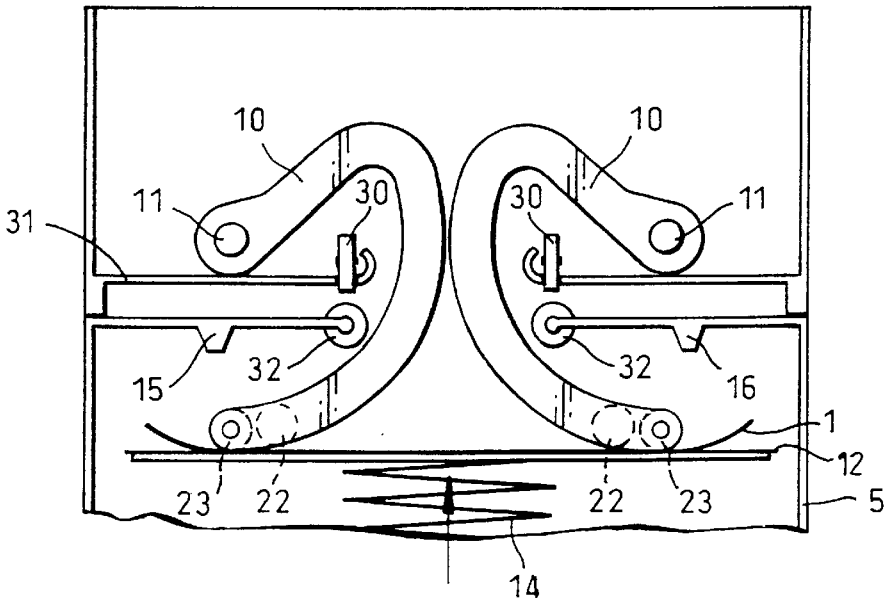

As the rotors 10 rotate further, their depth in the cashbox 5 increases. This is allowed for by the compression spring 14 which allows the support surface 13 to be depressed. As is shown in FIGS. 3*c* and 3*d*, the further rotation of the rotors 10 causes the rotating axles 23 of the respective rotors 10 to diverge. This has the effect of causing the banknote 1 to be further entrained about the trapped bearings 32 as the banknote 1 progressively enters the cashbox 5, until it has entirely entered the cashbox 5 and is flattened against stack surface 12; 13, as is shown in FIG. 3*d*. This occurs at the maximum degree of rotation of the rotors 10; approximately 90°. It is desirable that the actual degree of rotation of the rotors 10 is sufficient to make the banknote contacting portions 23 of the rotors 10 reach or just pass the point of maximum depth of penetration into the cashbox 5. This facilitates the unrolling of the banknote and reduces the risk of the banknote being incorrectly stacked.

At this point, as the rotors 10 are circular in profile the ends of each rotor are positioned directly beneath the axis about which they rotate.

As the rotors 10 rotate in the reverse direction, out of the cashbox 5, the banknote stack is biased under the influence of the spring 14 towards the aperture 4, against the retreating rotors 10. As the rotors 10 withdraw from cashbox 5 entirely, the stack surface 12; 13 is urged by the compression spring 14 against the abutment surfaces 15, 16 situated on the inside of the upper surface of the cashbox 5. The abutment surfaces 15, 16 ensure that positive control over the stack surface 12; 13 is always maintained.

This embodiment of the invention yields the same advantages as the first embodiment. In addition, however, the aperture 4 of the cashbox 5 may be smaller in this embodiment due to the absence of the pusher plate, which may increase the degree of security which may be imparted to a cashbox for use with this embodiment. In this embodiment of the invention the minimum width of the aperture 4 must be at least twice the thickness of rotor arm 20, approximately 14 mm. Therefore a minimum aperture width of approximately 15 mm may be achieved in this embodiment.

Furthermore the speed with which a banknote may be stacked may be increased as in this embodiment both rotors 10 act simultaneously, as opposed to the arrangement in the first embodiment where the rotor and the pusher plate are actuated at different times.

Third Embodiment

The third embodiment of the invention operates in a similar manner to that described with reference to the second embodiment and similar features will not be described further in detail.

In this embodiment, the rotors 40 are of a slightly different design compared to those previously described.

Figure 4A:
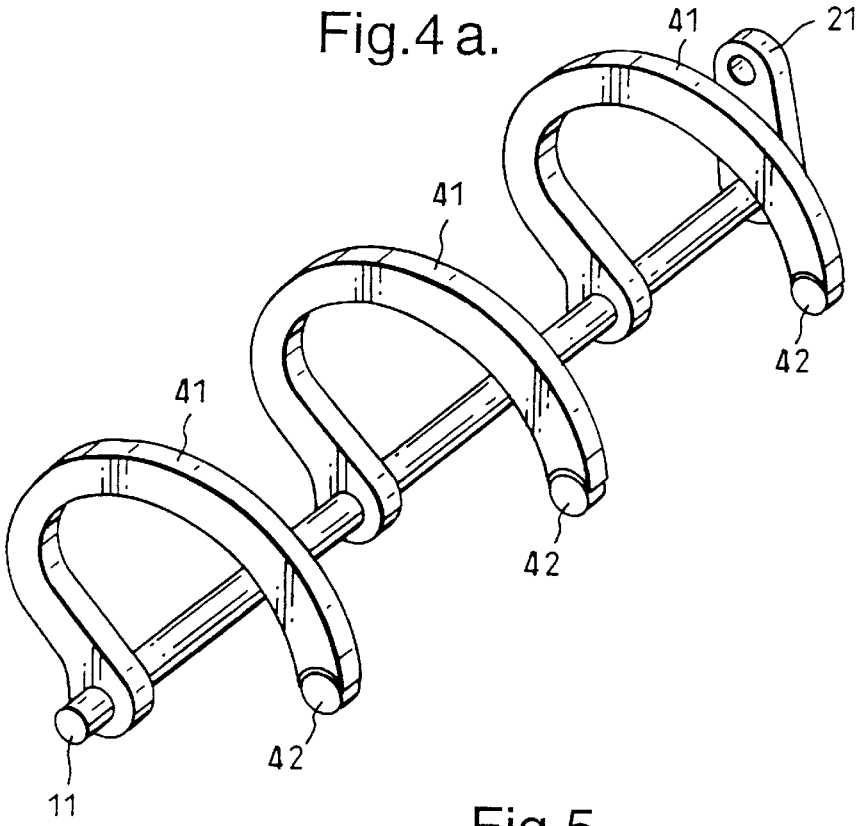
FIG. 4*a* illustrates a rotor according to the third embodiment of the invention.

Referring to FIG. 4*a*, a rotor according to the present embodiment is illustrated. Unlike the rotor 10 previously described, rotor 40 has no to support bar 22 or rotating axle 23. Rotor 40 has three rotor arms 41 (although this number could be higher or lower). At the end of each rotor arm 41 is a wheel 42. Each wheel 42 forms a banknote engaging surface, which fulfils the same function as the rotating axle 23 of rotor 10. Alternatively, the rotating wheels 42 may be replaced by non-rotating banknote contacting surface made from a low friction such as PTFE.

Figure 4B:
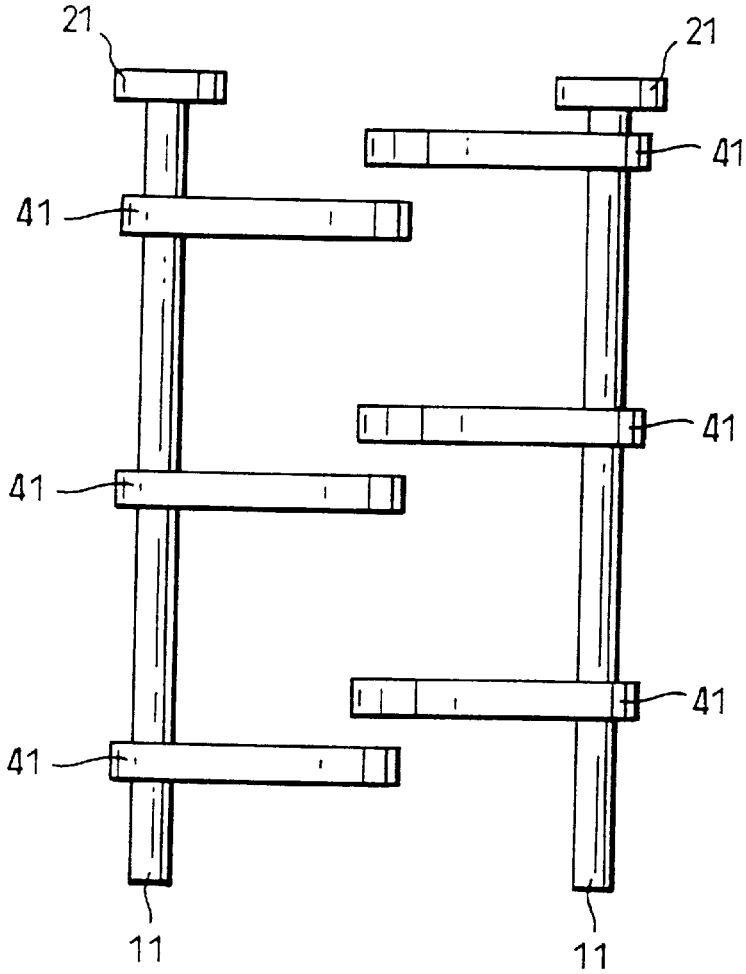
FIG. 4*b* is a 1:1 scale drawing illustrating the structure and arrangement of the rotors according to the third embodiment of the invention, shown from above in the resting state.
Figure 4C:
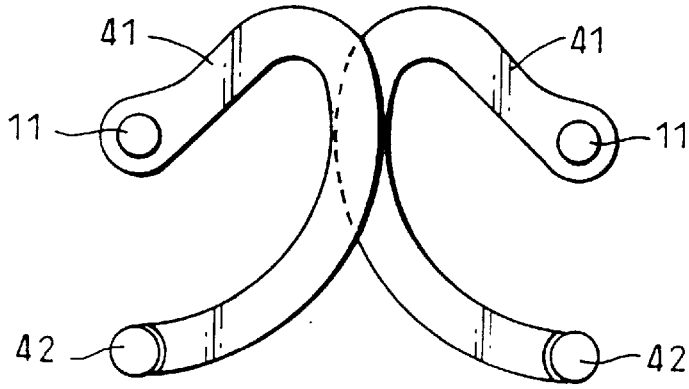
FIG. 4*c* is a 1:1 scale drawing illustrating a side view of the arrangement of the rotors according to the third embodiment of the invention, in operation.
Figure 6A:
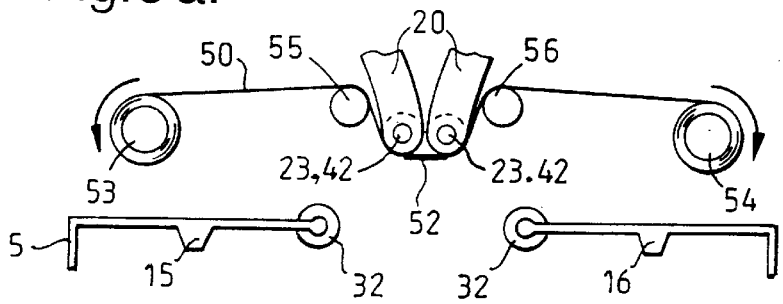
FIGS. 6*a–d* are a series of diagrams shown in 1:1 scale illustrating the working of the fourth embodiment of the invention with the cashbox partially removed.
Figure 6B:
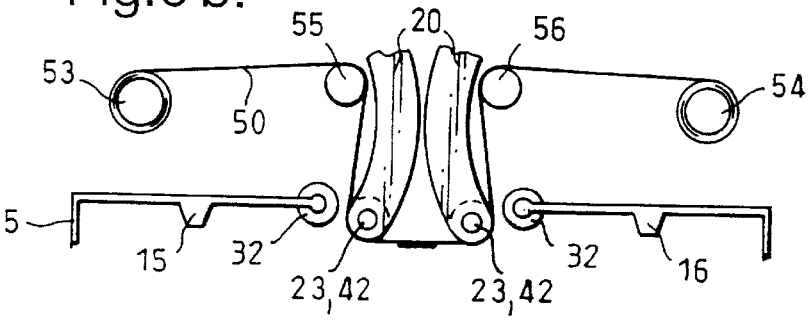
Figure 6C:
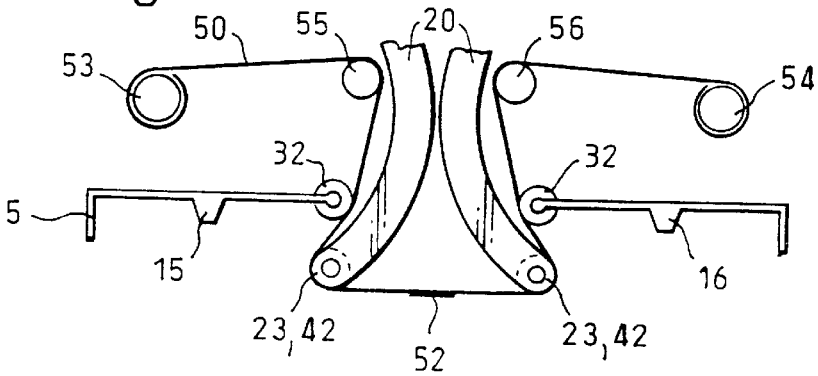
Figure 6D:
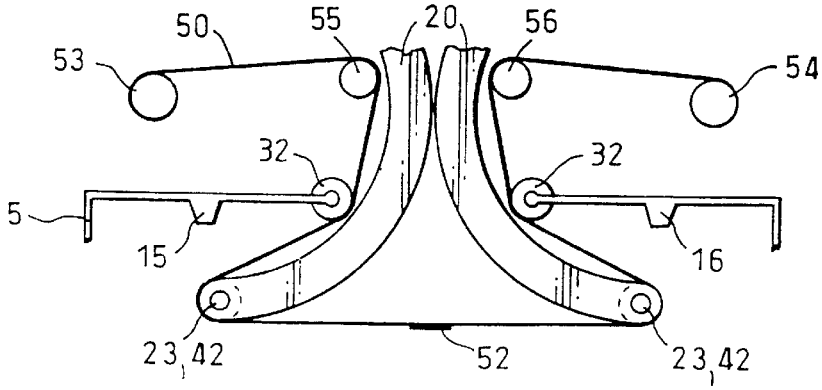

The arms 41 of opposing rotors 40 are thus arranged to interdigitate. This is illustrated in FIGS. 4*b* and 4*c* which respectively show the rotor structure and arrangement from above in the resting state and from the side in operation.

This provides the added advantage that aperture 4 of cashbox 5 may be made narrower, yet still allow the entry of the rotors in order to stack the banknotes; thus, cashbox 5 may be more easily made secure when it is removed from the validator. Specifically, the minimum width of the cashbox aperture 4 (approximately 10 mm in this embodiment) is limited by the thickness of one rotor arm 41, which in this case is 7 mm.

Fourth Embodiment

In the fourth embodiment the stacking mechanism operates in a similar manner to that described with reference to the second and third embodiments and similar features will not be described further. However, in the fourth embodiment the positional control exerted over the banknote 1 during the stacking process is improved through the use of a banknote contacting membrane 50 interposed between the rotors 10; 40 and the banknote 1.

Membrane

Figure 5:
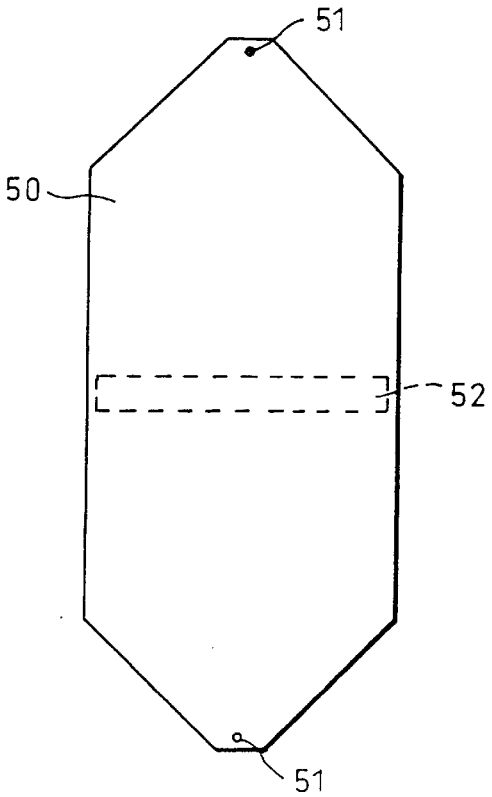
FIG. 5 is a plan view of the membrane used in the fourth embodiment of the invention.

A membrane 50 according to the present embodiment is illustrated in plan view in FIG. 5. The membrane 50 may be made of various wear resistant materials which may be produced in thin flexible sheets and suitable for rolling on rollers; such as polyester, mylar (TM), kevlar (TM) and Gore-tex (TM).

The membrane 50 is symmetrical about the dotted centre line and has a single connection point 51 situated at each end. The connection points 51 provide a means of attaching the membrane 50 to rollers 53, 54 upon which the membrane 50 is wound. It is advantageous to have a single point of attachment to each roller as this reduces the possibility of the membrane 50 becoming skewed when it is wound on or off the rollers 53, 54.

The membrane 50 also comprises a central friction strip 52, situated on its banknote contacting side. This is beneficial in terms of increasing control over the banknote 1 during the stacking process by increasing the level of friction between the membrane 50 and the banknote 1. In the present embodiment the friction strip 52 is made from vulcanised rubber which is bonded to the membrane 50. However, it may be made from any other suitable high friction material and attached to the membrane by any other suitable method, such as by stitching.

The membrane 50 is mounted upon rollers 53, 54, as shown in FIG. 6, which are spring loaded and mounted in the chassis of the stacker mechanism. This is achieved using springs (not shown) internal to the rollers 53, 54. The effect of the springs is to bias the rollers 53, 54 in the directions indicated by the arrows in FIG. 6*a*. Therefore, in its resting state the membrane 50 is held taught between the rollers 53, 54, entrained over two guide rollers 55, 56, which are also mounted in the chassis of the stacker mechanism, as shown in FIG. 6.

Stacking Operation

Referring to FIG. 7, a stacking mechanism according to the fourth embodiment of the invention is shown.

Figure 7A:
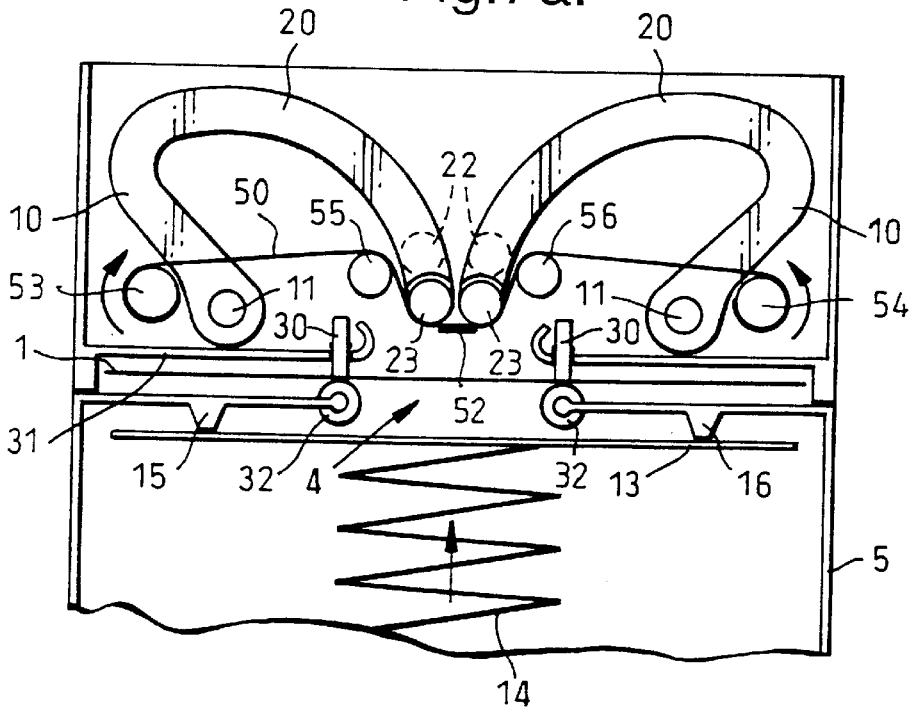
FIGS. 7*a–d* are a series of diagrams shown in 1:1 scale illustrating the working of fourth embodiment of the invention with the cashbox in place.

FIG. 7*a* illustrates the start of the stacking cycle, which is as described with reference to the second and third embodiments, with the exception of the addition of membrane 50, and so common features will not be discussed further in detail.

As the rotors 10; 40 are caused to rotate about their respective axes 11 they contact the membrane 50, which is positioned between the banknote 1 and the rotors 10; 40. Further rotation of the rotors 10 causes the membrane 21 to be pushed downwards and entrained first around the guide rollers 55, 56, as shown in FIG. 7*a* and then around trapped bearings 32, which are located at either side of the aperture 4. The purpose of the guide rollers 55, 56 is to prevent the membrane 50 from snagging on the rollers 30.

Figure 7B:
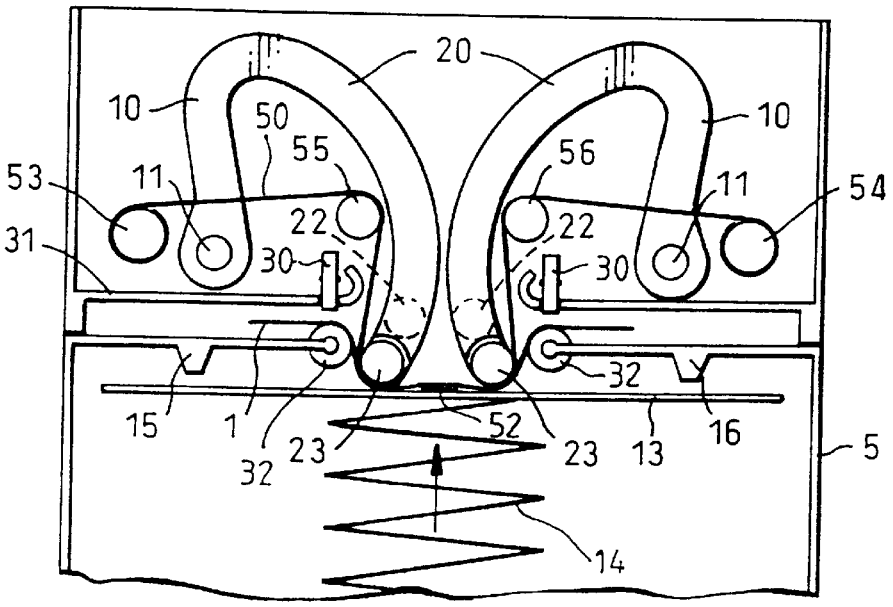

The rollers 53, 54 are caused to rotate in the directions indicated by the arrows in FIG. 7*a*, against their respective spring force bias, as the membrane 50 unrolls from them under the action of the rotors 10; 40. As the rotors 10; 40 move the membrane 50 downwards through the banknote transportation plane, as shown in FIG. 7*b*, the banknote 1 is contacted by the friction strip 52. As the friction strip 52 displaces only in a vertical sense, and hence remains centred in the mechanism throughout the stacking process, it serves to reduce any skewing of the banknote which might otherwise occur.

Figure 7C:
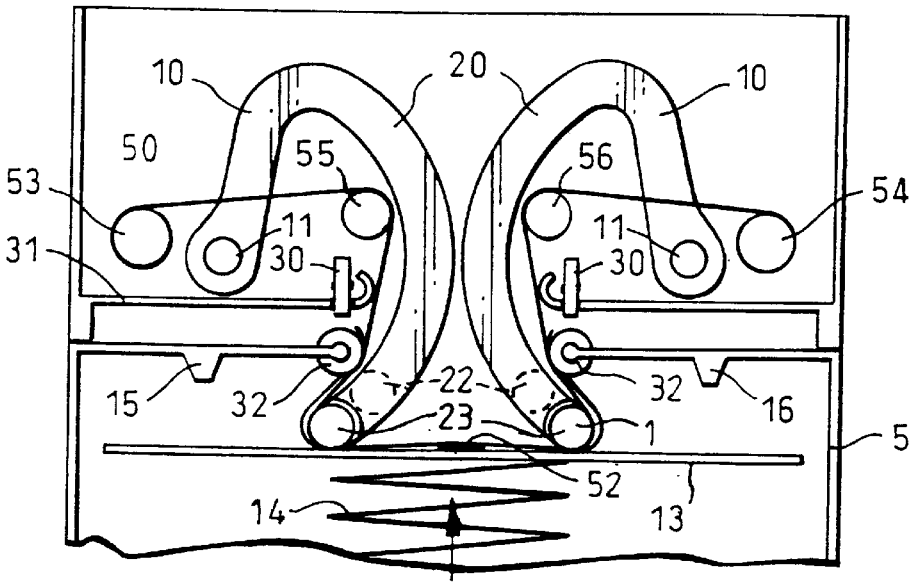
Figure 7D:
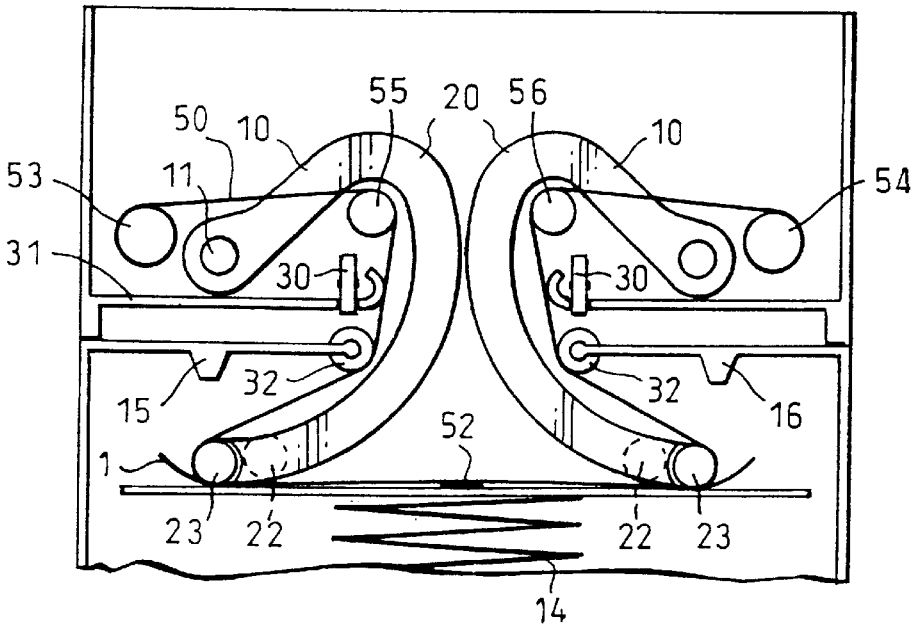

As the rotors 10; 40 rotate further, as shown in the sequence illustrated in FIGS. 7*b* to 7*d*, the banknote 1 is pushed through the cashbox aperture 4 and brought into contact with the stack surface 12;13 as shown in FIG. 7*b*. The banknote 1 is then unrolled in a sideways direction with respect to the stack surface 12;13 as shown in FIGS. 7*c* and 7*d*.

Subsequently, as the rotors 10; 40 rotate in reversed directions on exiting the cashbox 5, membrane 50 is tensioned by the springs in axles 53, 54, which ensure that there is no slack in the membrane 50 during the removal of rotors 10; 40, from cashbox 5. Since there is no relative movement between the membrane 50 and the stacked banknote 1 in the plane of the surface of the stack 12;13, the banknote 1 is not disturbed by the withdrawal of the rotors 10; 40 and the membrane 50.

Fifth Embodiment

Figure 8:
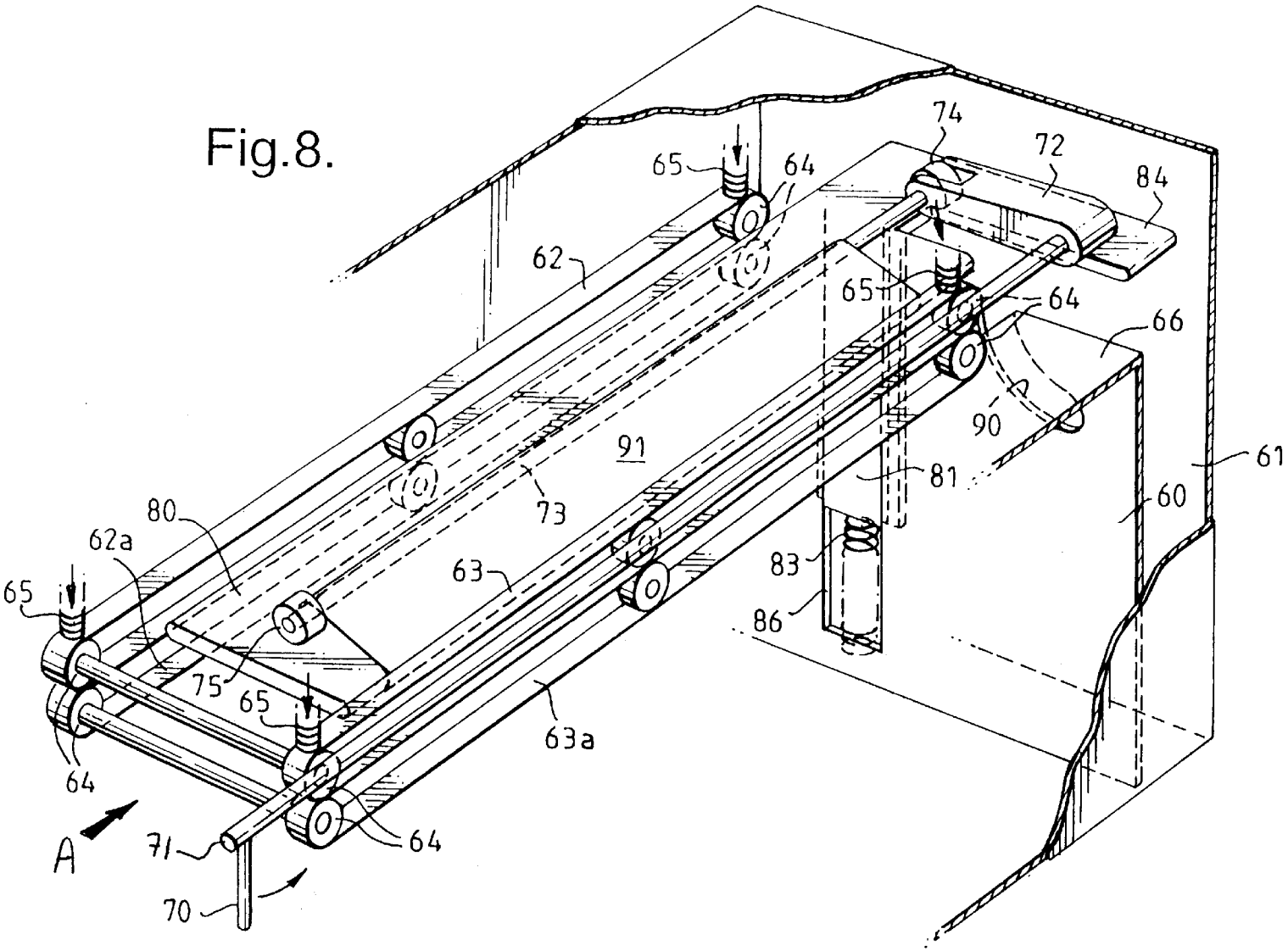
FIG. 8 is a perspective view of a banknote stacking mechanism according to the firth embodiment of the invention.
Figure 9:
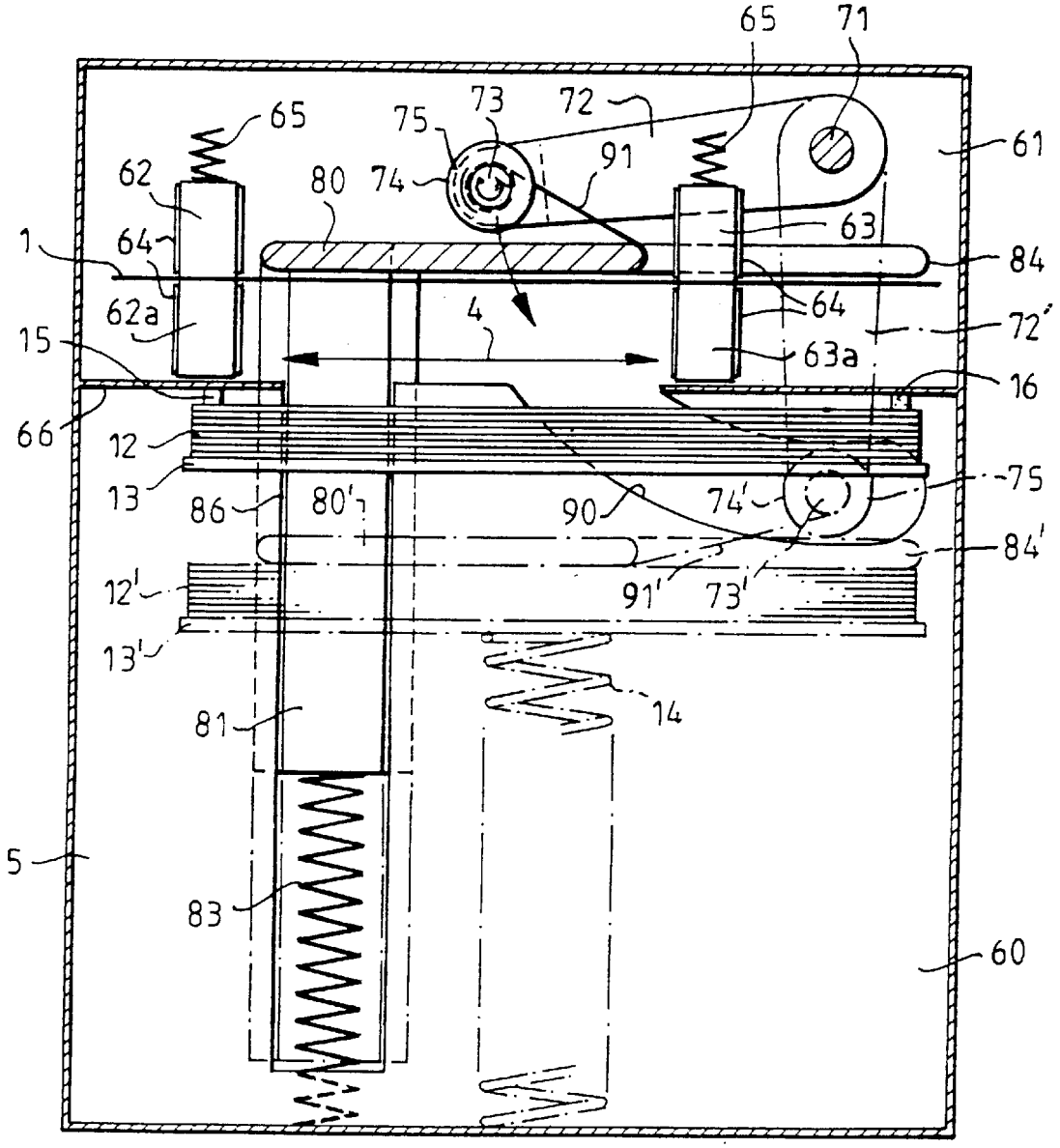
FIG. 9 is a cross sectional view of the banknote stacker of FIG. 8 illustrating its mode of operation.

Referring to FIGS. 8 and 9, a stacking mechanism according to the fifth embodiment of the invention is shown. In general terms, the mechanism of this embodiment fulfils the same functions as those described in the first embodiment. Features in this embodiment which are similar to features already discussed are referenced using the same reference numerals and will not be discussed further in detail.

Whereas the mechanism of the first embodiment incorporates a stacking mechanism and a transportation mechanism which are housed in a banknote handling apparatus, to which a cashbox is removably attached, the mechanism of the current embodiment incorporates part of the transportation mechanism and the entire stacking mechanism in the cashbox itself. This feature greatly enhances the level of security which may be provided for a detachable cashbox. As a result of this feature, the aperture 4 through which banknotes are stacked is internal to the outer casing of the cashbox. Therefore, on being detached from the banknote handling device, for example a validator, there is no external aperture large enough to allow a person to tamper with the contents of the cashbox.

Transportation Mechanism

Referring to FIG. 8, it will be noted that the cashbox according to the present embodiment consists of an inner and an outer envelope, referenced by numerals 60 and 61 respectively. A banknote 1 is introduced into the cashbox 5 in the direction of arrow "A", by the transportation mechanism of a banknote handling apparatus to which the cashbox 5 is attached. The aperture (not shown) through which a banknote 1 may be introduced into the cashbox need only be slightly larger than the width-wise cross sectional dimensions of the largest banknote 1 with which the apparatus is designed to work, further increasing the level of security of the cashbox 5. On entering the cashbox 5, the banknote 1 is engaged by opposing pairs of belts 62, 62*a* and 63, 63*a* which are arranged to grip the banknote 1 along each of its longitudinal edges. The belts 62, 62*a* and 63, 63*a* are driven by rollers 64, which in turn are driven by a connection (not shown) from the banknote handling apparatus drive mechanism through an aperture (not shown) in the wall of cashbox 5. The upper belts 62, 63 of the drive arrangement are biased using springs 65 in order to keep the banknote 1 firmly in contact with opposing belts 62*a*, 63*a*.

Stacking Mechanism

Referring to FIG. 9, it can be seen that as with previous embodiments, in this embodiment banknotes are stacked onto a plate 13 which is supported by a spring 14. This allows the banknote stack 12 to be displaced by the stacking mechanism as a new banknote 1 is stacked and to return as the stacking mechanism retreats in order that the uppermost banknote 1 in the stack 12 abuts the abutment surfaces 15, 16 of the upper wall 66 of the inner envelope 60 of the cashbox 5. Thus, the banknote stack 12 is always maintained under positive control as discussed in previous embodiments.

Referring again to FIG. 8, the stacking mechanism comprises an actuation lever 70 which is moveable in the direction of the arrow shown in FIG. 8 by an external drive mechanism (not shown). This may take the form of a simple gear, for example, connected via an aperture in the cashbox wall to an electric motor housed in the banknote handling apparatus. The rotation of actuation lever 70 causes the rigidly connected assembly of rod 71, connecting arm 72 and roller axle 73 to rotate about the longitudinal axis of rod 71, such that the roller axle 73 enters the cashbox aperture 4 (best seen in FIG. 9) in a radial channel 90 in the end wall of the inner cashbox envelope 60.

The actuation lever 70, rod 71, connecting arm 72 and roller axle 73 may be manufactured from any suitable rigid material such as steel and interconnected using standard manufacturing techniques.

The roller axle 73 has mounted at either end a roller 74, 75. Each roller 74, 75 is provided with a rubber tyre for engaging a piston 80, 81, 84 which will be described in more detail below. The roller axle 73 is secured at the end of roller 74 only, to connecting arm 72; thus avoiding the need for providing further channels in the internal envelope 60, which would be required for securing the second end of roller axle 73. The roller axle 73 is free to rotate against the spring bias of an internally mounted spring (not shown) housed in connecting arm 72, the biasing of which acts in the direction of the arrow shown in FIG. 9. The rollers 74 and 75 are mounted on the roller axle 73 such that they are free to rotate independently of the roller axle 73.

The banknote stacking mechanism further comprises a piston assembly, as mentioned above. The piston assembly comprises a banknote engaging plate 80. The plate 80 is dimensioned such that it just fits through the aperture 4 of the upper surface of the inner envelope 60 of cashbox 5, as viewed in FIGS. 8 and 9. The aperture 4 is in turn dimensioned such that its length (in the direction of banknote transportation) exceeds the length of the longest banknote with which the apparatus is designed to function.

The piston assembly is mounted in a slot 86 in the end wall of the inner envelope 60 which receives a reduced width portion of a guide piece 81 of the piston body, such that the guide piece 81 is free to move linearly in the slot 86. The guide piece 81 is held in a planar relationship with the end wall of the inner envelope 60 by the end wall of the outer envelope, with which it is a sliding fit. The guide piece 81 is acted on by a spring 83 which biases the piston body towards the upper surface 66 of the inner envelope 60 of cashbox 5 as viewed in FIGS. 8 and 9, such that in its resting condition, as is shown in FIG. 9, the plate 80 of the piston body is situated above the plane of a banknote 1 which is held between each side of the transport mechanism.

The piston body also comprises an arm 84 which extends perpendicularly to the guide piece 81 and which is co-planar with the plate 80. The entire piston body assembly may be made from any suitable rigid material, such as steel or a plastics material and may be made as a one piece moulding or may be assembled, using standard manufacturing techniques from components parts.

Entrained about the roller axle 73 is a membrane 91, similar to that described in the fourth embodiment. One edge of the membrane 91 is secured to the roller axle 73. The membrane 91 extends from near the roller 75, along approximately the entire length of the plate 80.

The other edge of the membrane 91 is secured to a longitudinal edge of plate 80, for example by adhesion, as is shown in FIGS. 8 and 9.

Mode of Operation

As has been described with reference to the previous embodiments, the banknote 1 is transported by the transportation mechanism and held stationary above the aperture 4 prior to the initiation of the stacking procedure. Subsequently, the belt transport system 62 is raised relative to its opposing belt 62*a* in order to create a clearance between the belts 62 and 62*a* such that an edge of the banknote 1 may be withdrawn during the stacking operation. This is initiated by the rotation of actuation lever 70 in the direction indicated by the arrow on FIG. 9 and as previously described this results in the rotation of roller axle 73 into the inner envelope 60 of cashbox 5 along the radial slot 90 in the end wall of the inner cashbox 60. In so doing, roller 74 acts on the arm 84 of the piston body, forcing the piston body to slide vertically down into the inner envelope 60 of cashbox 5, along slot 86. This in turn causes the underside of the plate 80 to come into contact with the upper surface of the banknote 1, which is entrained by the plate 80 through the aperture 4 and onto the upper surface of the stack of banknotes 12 in the cashbox, or, onto the support plate 13 if the cashbox is empty.

Once the piston plate 80 has secured one edge of the banknote 1 against the banknote stake 12, the second banknote edge is release by the raising of the belt transport system 63 relative to its opposing belt transport system 63*a*.

As the actuation lever 70 continues to rotate in the direction of the arrow shown in FIG. 8, the action of roller 74 continues to force the piston body downwards against the action of spring 14 shown in FIG. 9. Thus, as the roller axle 73 moves across the upper surface of the plate 80, the membrane 91 is wound onto the roller axle 73 by virtue of the biasing spring (not shown) in connecting arm 72 which acts upon the roller axle 73. This continues until the point at which the roller axle 73 passes off the right hand edge of plate 80, as viewed in FIG. 9.

Continued rotation of the actuation lever 70 causes the membrane 91 to unwind, against the action of the spring (not shown) acting upon the roller axle 73 until the roller axle 73 reaches its maximum depth of penetration into the inner envelope 60 of the cashbox 5. This state is shown in FIG. 9 by the dashed representation of connecting arm 72', roller axle 73', roller 75', plate 80', membrane 91', banknote stack 12' and support plate 13'. Thus, the action of roller axle 73, together with that of the membrane 91 has at this point flattened the remainder of the banknote 1 against the stack 12.

It should be noted that in this embodiment, as with the mechanism of the first embodiment, the final stacked position of the banknote is laterally offset with regard to the position of the banknotes during transportation.

It should also be noted that at this point, roller 74 continues to exert a downward force on the piston body, via the extreme end of arm 84. This is despite the fact that the roller axle 73 is no longer situated above plate 80.

The actuation mechanism then proceeds to drive actuation lever 73 in the reverse direction to rotate the roller axle 73 back out of the inner envelope 60 of cashbox 5 along the radial path defined by slot 90. The biasing force of spring 83 causes the piston body to return to its normal position, shown in full line in FIG. 9.

Similarly the biasing force of the spring (not shown) which acts on roller axle 73 causes the membrane 91 to be once again wound onto the roller axle 73 up until the point at which the roller axle 73 again reaches the upper surface of the plate 80, leaving the banknote in its stacked position. And thereafter to unwind again as the position shown in FIG. 9 is approached.

The skilled reader will appreciate that the present embodiment has the advantages described earlier with respect to the first embodiment of being tolerant of misalignment of the banknote 1 as it is presented for stacking, since no datum edge is relied upon in order to effect the stacking operation.

Similarly, because each banknote 1 is effectively stacked by positioning part of the banknote 1 on the stack 12 and subsequently flattening the remainder against the stack 12, this embodiment is also able to cope with a wide range of banknote sizes. However, in addition, the presence of the membrane 91 further increases the control which may be exerted upon the banknote 1 during the stacking operation.

Furthermore, the tensile stresses imparted to the banknote 1 are reduced by the presence of the membrane 50. Therefore, the chances of the banknote 1 being torn by the stacking process are further reduced. Accordingly, the speed of the stacking cycle may be further increased.

Figure 10A:
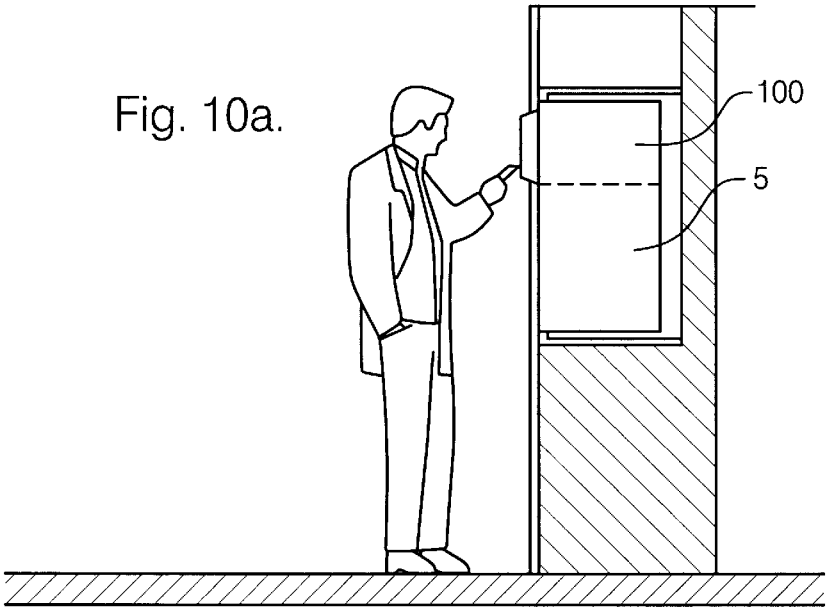
FIGS. 10*a* and 10*b* illustrate a banknote handling machine including a cashbox with which a stacking mechanism according to the present invention may be used.
Figure 10B:
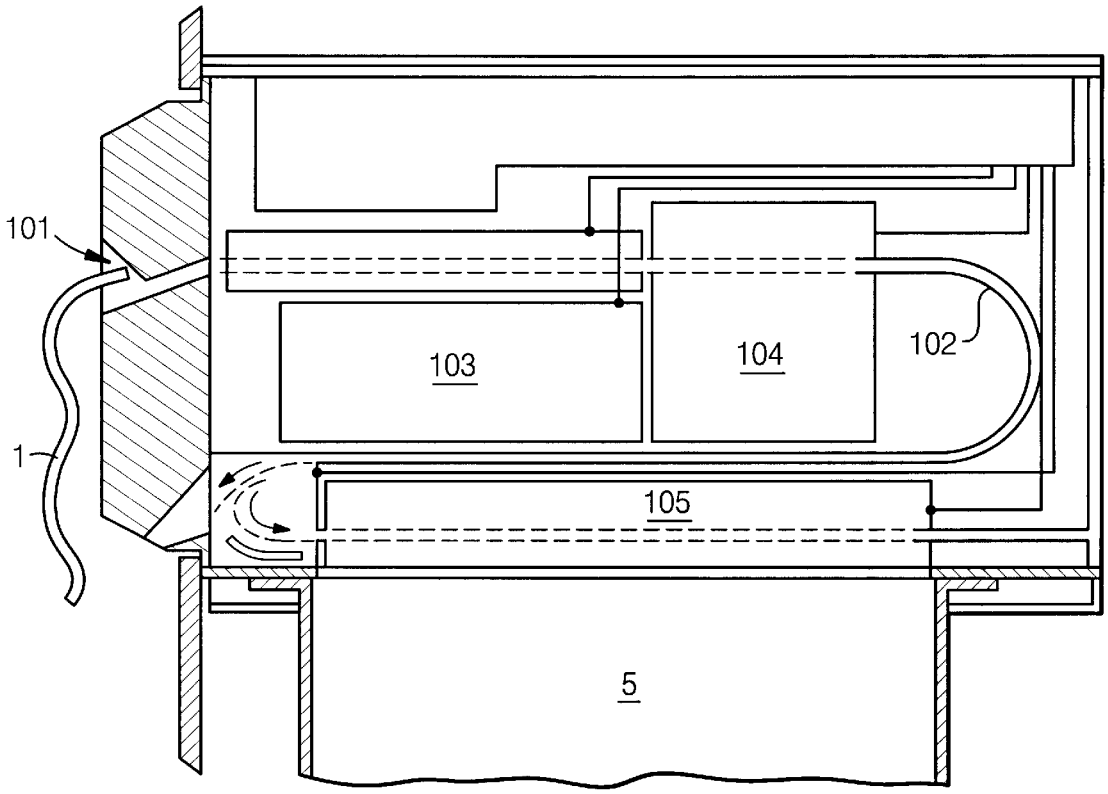

The skilled reader will understand that a banknote stacking apparatus according to the present invention may be used in various applications, particularly where banknotes are automatically accepted and validated such as in automated vending machines and banknote changing machines. Referring to FIG. 10*a* a banknote validating machine 100 is shown in conjunction with a cashbox 5. Referring now to FIG. 10*b*, an idealised sectional view through the machine 100 is shown. This shows a banknote 1 on the point of being inserted into an aperture 101 from where it is transported along a banknote transportation system 102 by a drive unit 103 and validated by a validation apparatus 104. The transportation system 102 then transports the banknote 1 to a stacking arrangement 105 so that the banknote 1 may be stacked in the cashbox 5 as has been described in previous embodiments, the stacking arrangement 105 may be located in the validator 100 as it is shown in FIG. 10*b* or alternatively in the cashbox 5 itself.

Furthermore, it will be appreciated by the skilled reader that the stacking arrangement 105 employed in a banknote accepting machine may conform to any one of the previously described embodiments.

It will be apparent from the forgoing that various modifications and variations may be employed in relation to the above-described embodiments without departing the spirit or scope of the present invention. In particular, features of the embodiments described may be employed individually or in individual combinations without departing from the scope of the invention.

For example the skilled reader will appreciate that the present invention as described in the second, third and fourth embodiments, could be used to insert documents such as banknotes, loosely through an aperture; thus obviating the need to any stack forming means.

Furthermore, the skilled reader will appreciate that by adjusting the clearance between the upper and the lower halves of the banknote transport mechanism, the present invention could be used to stack bundles of banknotes, which have been held, for example, in a temporary storage device such as an escrow.

The skilled reader will also appreciate that various modifications may be made to the mechanism with which the rotors and the pusher plate are driven. For example, both the rotors and the pusher plate may be driven by a single, non-reversible electric motor, their actuation timing being controlled through the use of cams, for example. Furthermore, the banknote transport mechanism may be arranged to deliver banknotes for stacking at predetermined intervals, allowing the continuous operation of the stacking mechanism.

The skilled reader will also realise that the inventive concept of the present invention may be realised using stacking members which would not normally be termed rotors. For example, the opposing rotors of the second embodiment may be replaced with parallel rods, each supported at either end in an "L" shaped channel. By moving the rods in the "L" shaped channels the required downward and sideways movement for stacking a sheet according to the present invention may be accomplished.

What is claimed is:

1. A device for stacking banknotes, comprising a cashbox and a stacker arranged to stack banknotes of predetermined dimensions in said cashbox, said cashbox having a surface including an aperture therein, said aperture having a dimension in a first direction of W, said device being arranged to receive a banknote at a position overlying said aperture, said banknote having a dimension in said first direction of L, said stacker being arranged to push said banknote through said aperture and into a stacked position in said cashbox, wherein said banknote is pushed to a predetermined maximum depth D in said cashbox relative to said aperture such that $D<(L-W)/2$.

2. A device according to claim 1, further comprising means to retain the stacked banknote in a stack.

3. A device according to claim 1, wherein the width of the aperture is less than the minimum width of a banknote to be stacked.

4. A device according to claim 1, wherein the width of the aperture is approximately half of the width of a banknote.

5. A device according to claim 1, wherein the width of the aperture is approximately a quarter of the width of a banknote or less.

6. A device according to claim 1, wherein the width of the aperture is approximately 24 mm.

7. A device according to claim 1, wherein the width of the aperture is approximately 10 mm or more.

8. A device according to claim 1, wherein the width of the aperture is approximately 15 mm or more.

9. A device according to claim 1, wherein the device further comprises means to bias the stack toward the aperture.

10. A device according to claim 9, wherein the biasing means comprises at least one spring.

11. A device according to claim 1, wherein the stacker comprises at least one rotor arranged to rotate about an axis, such that it may pass through the aperture and move along a stack surface.

12. A device according to claim 11, wherein the stacker comprises a piston arranged to push a banknote through the aperture such that the banknote contacts the stack surface.

13. A device according to claim 11, wherein the stacker further comprises a second rotor, each said rotor being supported on an axle and comprising a banknote engaging portion free to rotate about a respective axle, the banknote engaging portion of each rotor being arranged to pass through said aperture and to contact the stack.

14. A device according to claim 13, wherein the stacker is arranged to move along the surface of the stack simultaneously in two mutually opposed directions, each said direction being substantially perpendicular to the length of the aperture.

15. A device according to claim 11, wherein said rotor comprises a banknote engaging portion free to rotate about a respective axle, and has at least one roller located on the banknote engaging portion, free to rotate on the surface of the banknote.

16. A device according to claim 11, wherein said rotor comprises a banknote engaging portion free to rotate about a respective axle and wherein the banknote engaging portion is formed of a low friction substance.

17. A device according to claim 16, wherein the banknote engaging portion of at least one rotor comprises PTFE.

18. A device for stacking banknotes, comprising a cashbox and a stacker arranged to stack banknotes of predetermined dimensions in said cashbox, said cashbox having a surface including an aperture therein, said aperture having a dimension in a first direction of W, said device being arranged to receive a banknote at a position overlying said aperture, said banknote having a dimension in said first direction of L, said stacker being arranged to push said banknote through said aperture and into a stacked position in said cashbox, wherein said banknote is pushed to a predetermined maximum depth D in said cashbox relative to said aperture such that $D>(L-W)/2$, further comprising an extensible membrane positioned between the stacker and the banknote, arranged to contact the banknote during the stacking procedure.

19. A device according to claim 18, wherein the membrane is mounted on at least one spring biased roller.

20. A device according to claim 18, wherein the membrane comprises a frictionfull banknote contacting portion.

21. A device for stacking banknotes, comprising a cashbox and a stacker arranged to stack banknotes of predetermined dimensions in said cashbox, said cashbox having a surface including an aperture therein, said aperture having a dimension in a first direction of W, said device being arranged to receive a banknote at a position overlying said aperture, said banknote having a dimension in said first direction of L, said stacker being arranged to push said banknote through said aperture and into a stacked position in said cashbox, wherein said banknote is pushed to a predetermined maximum depth D in said cashbox relative to said aperture such that $D<(L-W)/2$, wherein the aperture comprises at least one roller around which the banknote is entrained whilst the banknote is being pushed through said aperture.

22. A device for stacking banknotes, comprising a cashbox and a stacker arranged to stack banknotes of predetermined dimensions in said cashbox, said cashbox having a surface including an aperture therein, said device being arranged to receive a banknote at a position overlying said aperture, and said stacker being arranged to push said banknote through said aperture such that when said banknote first reaches a maximum depth in said cashbox relative to said aperture, a portion of said banknote extends outside said cashbox through said aperture.

23. A device for stacking documents comprising a stacker and a stack surface, the stacker being arranged to push a document partially through an aperture defined by at least one surface such that the document at least partially contacts the stack, the stacker being further arranged to move along the stack and under the surface, entraining the document through said aperture into a stacked position, wherein the stacker comprises an extensible membrane positioned between the stacker and the document, arranged to contact the banknote during the stacking procedure.

24. A device for stacking documents comprising: a stacker and a stack; the stacker being arranged to push a document from a first position overlying an aperture partially through said aperture to a second position at a maximum depth wherein the document at least partially contacts the stack, said aperture being defined by at least one surface, the stacker being further arranged to move along the stack and under the surface, entraining the document through said aperture into a stacked position.

25. A device for encashing banknotes, comprising an encashing device and a cashbox, the cashbox comprising an aperture in a surface, the encashing device being arranged to push a banknote partially through said aperture from a first side to a second side of the surface, in a direction substantially perpendicular to the plane of said surface and then to entrain the banknote through the aperture by moving on the second side of the surface in a direction substantially parallel to the plane of the surface.

26. A method of stacking banknotes of predetermined dimensions in a cashbox using a stacker, said cashbox having a surface including an aperture therein, said aperture having a dimension in a first direction of W, comprising:

receiving a banknote at a position overlying said aperture, said banknote having a dimension in said first direction of L; and pushing said banknote with said stacker through said aperture and into a stacked position in said cashbox to a predetermined maximum depth D in said cashbox relative to said aperture such that $D<(L-W)/2$.

27. A method of stacking a document onto a stack comprising:

pushing the document from a first position overlying an aperture partially through said aperture to a second position at a maximum depth such that the document at least partially contacts the stack; and moving the stacker along the stack and under a surface defining the aperture, so as to entrain the document through said aperture into a stacked position.

* * * * *